US006190527B1

(12) United States Patent
Hashimoto et al.

(10) Patent No.: US 6,190,527 B1
(45) Date of Patent: Feb. 20, 2001

(54) ELECTROCOAGULATION PRINTING APPARATUS

(75) Inventors: Shigeto Hashimoto; Toshio Oshida, both of Tokyo (JP)

(73) Assignee: Toyo Ink Mfg. Co., Ltd., Tokyo (JP)

( * ) Notice: Under 35 U.S.C. 154(b), the term of this patent shall be extended for 0 days.

(21) Appl. No.: 09/283,870

(22) Filed: Apr. 1, 1999

(51) Int. Cl.[7] ..... C25D 1/12; C25D 13/00; C25D 15/00

(52) U.S. Cl. ..... 204/623; 204/622; 101/DIG. 37

(58) Field of Search ..... 204/483, 622, 204/623; 101/465, 466, 489, DIG. 37

(56) References Cited

U.S. PATENT DOCUMENTS

| | | | | |
|---|---|---|---|---|
| 4,555,320 | | 11/1985 | Castegnier . | |
| 4,881,835 | * | 11/1989 | Niikawa | 400/56 |
| 5,121,688 | * | 6/1992 | Williams et al. | 101/142 |
| 5,693,206 | * | 12/1997 | Castegnier et al. | 204/623 |

FOREIGN PATENT DOCUMENTS 0 566 540 10/1993 (EP) .

* cited by examiner

*Primary Examiner*—Kathryn Gorgos
*Assistant Examiner*—Wesley A. Nicolas
(74) *Attorney, Agent, or Firm*—Oblon, Spivak, McClelland, Maier & Neustadt, P.C.

(57) ABSTRACT

An electrocoagulation printing apparatus includes a cylindrical positive electrode, an ink supplying device, a printing head having negative electrodes forming dots of coagulated ink, a removing device for removing non-coagulated ink, a transfer device for bringing the dots of the coagulated ink into contact with an substrate and transferring the dots on the substrate, a gap measurement sensor, and gap control device. The gap measurement sensor measures the size of the gap between the positive electrode and the negative electrodes, and outputs the measured value to the gap control device. The gap control device changes the size of the gap by moving the negative electrodes with respect to a surface of the positive electrode such that the input measured value of the gap falls within a desired established range.

14 Claims, 11 Drawing Sheets

ELECTROCOAGULATION PRINTING APPARATUS

BACKGROUND OF THE INVENTION

The present invention relates to an electrocoagulation printing apparatus for reproducing an image by electrocoagulation of ink and transferring the image thus reproduced onto a substrate.

U.S. Pat. No. 4,895,629, discloses an electrocoagulation printing apparatus including opposed frames, a cylindrical positive electrode, coating means, ink feed means, a printing head, and a pressure roller.

The positive electrode is rotatably supported between the frames. The positive electrode is provided at its outer peripheral surface with a passivated surface defining a positive electrode active surface.

A printing head includes pin-like negative electrodes, and is supported between supporting bars extending upward from the frames. A gap of about 50 μm is formed between the outer peripheral surfaces of the negative electrode of the printing head and an outer peripheral surface of the positive electrode.

The coating means coats oily material on the surface of the positive electrode. The electrocoagulation printing ink which includes the coloring agent is injected into the gap from the ink feed means. When the negative electrode is electrically energized, multivalent metal ions are generated from the positive electrode, and dots of the coagulated ink representing a desired image are formed on the surface of the positive electrode.

The pressure roller is rotatably supported between brackets extending from the frames in a lateral direction, and transfers the coagulated ink from the surface of the positive electrode to a paper web, thereby printing the desired image on the web.

SUMMARY OF THE INVENTION

For example, a preferable size of the gap under a certain condition is very small and is about 50 μm. Since the size of the gap affects the print image, it is necessary to keep the gap within a range of 50 μm±5 μm. For example, if the gap is 40 μm or less, there is a possibility that a void in a highly density region is generated due to shortage of ink. If the gap is 60 μm or greater, there is a possibility that unclear image is printed due to bad dot formation. When the gap is greater than a distance between the negative electrodes, there is a possibility that the negative electrodes are damaged due to electricity flowing between the negative electrodes. In order to prevent such an inconvenience, an operator needs to frequently adjust the size of the gap using a precision screw, which is troublesome.

Further, the size of the gap may be varied because constituent elements of the apparatus are expanded or contracted due to variation in temperature or load. For example, assuming that a distance from the surface of the positive electrode to the supporting portion of the printing head is 170 mm, the frames and the supporting bars are made of stainless steel, and the temperature is varied by 10° C., it is known that the size of the gap is varied by about 28 μm. Therefore, in order to keep the quality of the printed image constant, it is necessary to frequently adjust the gap during the printing operation. However, since the gap can not be adjusted when the apparatus is operated continuously, and the apparatus must be interrupted for adjusting the gap, it is difficult to enhance both the quality and the quantity of print.

It is an object of the present invention to provide an electrocoagulation printing apparatus capable of stably obtaining an image of high quality without interrupting the operation of the apparatus.

To achieve the above object, an electrocoagulation printing apparatus of the invention comprises: a positive electrode having a positive electrode active surface; a printing head having a negative electrode spaced from the positive electrode active surface by a gap; feed means for supplying ink into the gap, dots of coagulated ink for representing a desired image produced from the ink on the positive electrode active surface as the negative electrode is electrically energized; removing means for removing any non-coagulated ink from the positive electrode active surface; transfer means for bringing a substrate into contact with the dots of coagulated ink to cause transfer of the coagulated ink from the positive electrode active surface onto the substrate and thereby imprint the substrate with the image; gap measurement means for measuring the gap between the positive electrode active surface and the negative electrode; and gap control means for controlling the gap according to output from the gap measurement means.

With the above structure, the ink is supplied from the feed means into the gap, and if the negative electrode is electrically energized, the dots of the coagulated ink representing the desired image is produced on the positive electrode active surface. After the non-coagulated ink on the positive electrode active surface is removed by the removing means, the dots of the coagulated ink are transferred to the substrate by the transfer means, thereby imprint the substrate with the desired image.

The gap between the positive electrode active surface and the negative electrode is measured by the gap measurement means, and the measured value is sequentially output to gap control means. The gap control means controls the size of the gap in accordance with the input measured value. If the gap is changed during the operation of the apparatus, the gap control means sequentially controls the size of the gap appropriately.

Therefore, since the size of the gap during the operation is appropriately maintained automatically, it is possible to stably obtain an image of high quality without interrupting the apparatus.

The gap measurement means may include a gap measurement sensor, the gap control means may include a driving arrangement, and the driving arrangement may move the negative electrode so that a measured value by the gap measurement sensor falls within an established value.

With the above structure, if the size of the gap is changed, and the measured value by the gap measurement sensor falls out of the established value, the gap control means operates the driving arrangement to move the negative electrode. With this operation, the measured value falls within the established value.

The electrocoagulation printing apparatus may further include a movable unit with the printing head and the gap measurement sensor, and the positive electrode maybe rotatably connected to a frame body, the movable unit may be movably connected to the frame body, and the driving arrangement may move the movable unit.

With the above structure, if the measured value falls out of the established value, the gap control means operates the driving arrangement to move the movable unit. With this operation, the negative electrode is moved and the measured value falls within the established value.

The movable unit may include a supporting axis, a rotary axis and a lever, the printing head and the gap measurement sensor may be fixed with respect to the supporting axis, the supporting axis may be fixed with respect to the rotary axis, the rotary axis may be rotatably connected to the frame body, the lever may be projected from the rotary axis, the driving arrangement may include a push bar, a drive transmission mechanism, and a driving motor, the push bar may be movable up and down and may come in engagable contact with the lever for moving the lever, and the driving motor may be linked to the push bar via the drive transmission mechanism.

With the above structure, if the measured value falls out of the established value, the gap control means operates the driving motor. With this operation, the push bar moves up or down, the rotary axis rotates, the supporting axis is moved up or down, the negative electrode moves and the measured value falls within the established value.

The drive transmission mechanism may include a nut member, a vertical ball screw and a second abutment portion, the nut member may be fixed with respect to the push bar, the ball screw may be screwed with the nut member, and the second abutment portion may be provided below the lever.

With the above structure, if the driving motor is driven, the ball screw rotates, the nut member and the push bar move up or down, the rotary axis rotates, and the negative electrode moves. The lever contacted with the second abutment portion is prevented from moving down by the second abutment portion. Therefore, it is possible to prevent the printing head from being lowered excessively and from colliding against the positive electrode and being damaged.

The gap measurement means may include first and second gap measurement sensors, the gap control means may include a driving arrangement, and the driving arrangement may move the negative electrode so that a first measured value by the first gap measurement sensor falls within a first established value and a second measured value by the second gap measurement sensor falls within a second established value.

With the above structure, if the first and second measured values fall out of the first and second established values, respectively, the gap control means operates the driving arrangement to move the negative electrode. Therefore, the first and second measured values fall within the first and second established values, respectively. Thus, it is possible to appropriately control the size of the gap even if the gap is formed widely.

The gap measurement means may include first and second gap measurement sensors, the gap control means may include first and second driving arrangements, and the first and second driving arrangements may move the negative electrode so that a first measured value by the first gap measurement sensor falls within a first established value and a second measured value by the second gap measurement sensor falls within a second established value.

With the above structure, if the first measured value falls out of the first established value, the gap control means operates at least one of the driving arrangements to move the negative electrode. If the second measured value falls out of the second established value, the gap control means operates at least one of the driving arrangements to move the negative electrode. Therefore, the first and second measured values fall within the first and second established values, respectively. Thus, it is possible to appropriately control the size of the gap even if the gap is formed widely.

The electrocoagulation printing apparatus may further include a movable unit with the printing head and the first and second gap measurement sensors, and the positive electrode may be connected to a frame body, the movable unit may be movably connected to the frame body, and each of the driving arrangements independently may move the movable unit.

With the above structure, if the first measured value falls out of the first established value, the gap control means operates at least one of the driving arrangements to move the movable unit. If the second measured value falls out of the second established value, the gap control means operates at least one of the driving arrangements to move the movable unit. With this operation, the negative electrode moves, and the first and second measured values fall within the first and second established values, respectively, The movable unit may include a supporting axis and first and second supporting bars, the printing head and the gap measurement sensors may be fixed with respect to the supporting axis, the supporting bars may be rotatably connected to a shaft fixed to the frame body, the supporting axis may be connected between the first and second supporting bars, each of the riving arrangements may include a push bar, a drive transmission mechanism, and a driving motor, each of the supporting bars may have a first abutment portion, the push bar may be movable up and down and may come in engagable contact with the first abutment portion for moving each of the supporting bars, and the driving motor may be linked to the push bar via the drive transmission mechanism.

With the above structure, if the first measured value falls out of the first established value, the gap control means operates at least one of the driving arrangements. Similarly, if the second measured value falls out of the second established value, the gap control means operates at least one of the driving arrangements. In the driving arrangement whose driving motor is operated, the corresponding push bar moves up or down, and the supporting bars pivots around the shaft. With this operation, the negative electrode moves, and the first and second measured values fall within the first and second established values, respectively.

The drive transmission mechanism may include a nut member, a vertical ball screw and a second abutment portion, the nut member may be fixed with respect to the push bar, the ball screw may be screwed with the nut member, and the second abutment portion may be provided below the lever.

With the above structure, if the driving motor is driven, the ball screw rotates, the nut member and the push bar move up or down, the supporting bar pivots around the shaft, and the negative electrode moves, The lever contacted with the second abutment portion is prevented from moving down by the second abutment portion. Therefore, it is possible to prevent the printing head from being lowered excessively and from colliding against the positive electrode and being damaged.

The movable unit may include a supporting axis with first and second head supporting portions, the printing head and the gap measurement sensors may be fixed with respect to the supporting axis, and each of the driving arrangements may move each of the head supporting portions respectively.

With the above structure, if the first measured value falls out of the first established value, the gap control means operates at least one of the driving arrangements. Similarly, if the second measured value falls out of the second established value, the gap control means operates at least one of the driving arrangements. In the driving arrangement whose driving motor is operated, the corresponding head supporting portion moves. With this operation, the negative electrode moves, and the first and second measured values fall within the first and second established values, respectively.

Each of the driving arrangements may include a nut member, a ball screw and a driving motor, the nut member may be arranged to each of the head supporting portions, and the ball screw may be extended from the frame body, screwed with the nut member and connected to the driving motor.

With the above structure, in each of the driving arrangements, if the driving motor is driven, the ball screw rotates, the nut member and each of the head supporting portions move up or down, and the negative electrode moves.

The gap sensor may be an eddy-current type distance sensor.

With the above structure, the size of the gap can be precisely measured irrespective of whether the coagulated ink exists in the gap.

The gap measurement means may include a gap measurement sensor, the gap control means may include a driving arrangement, and the driving arrangement may move the negative electrode so that a measured value by the gap measurement sensor agrees with an established value.

With the above structure, if the measured value does not coincide with the established value, the gap control means operates the driving arrangement to move the negative electrode. With this operation, the measured value coincides with the established value.

DESCRIPTION OF THE PREFERRED EMBODIMENTS

A first embodiment of the present invention will be explained below based on the drawings.

Figure 1:
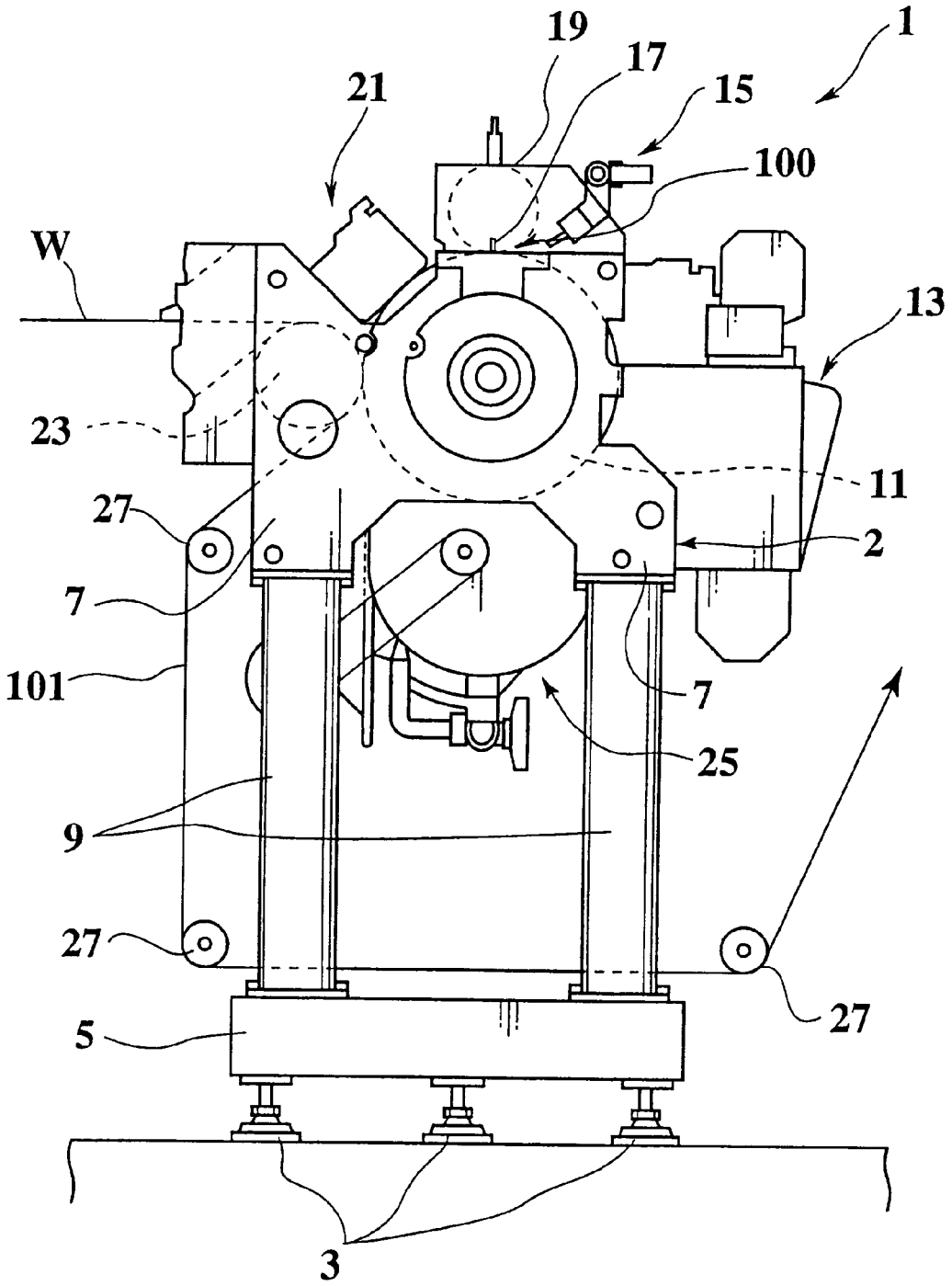
FIG. 1 is a side view showing an electrocoagulation printing apparatus of a first embodiment.
Figure 2:
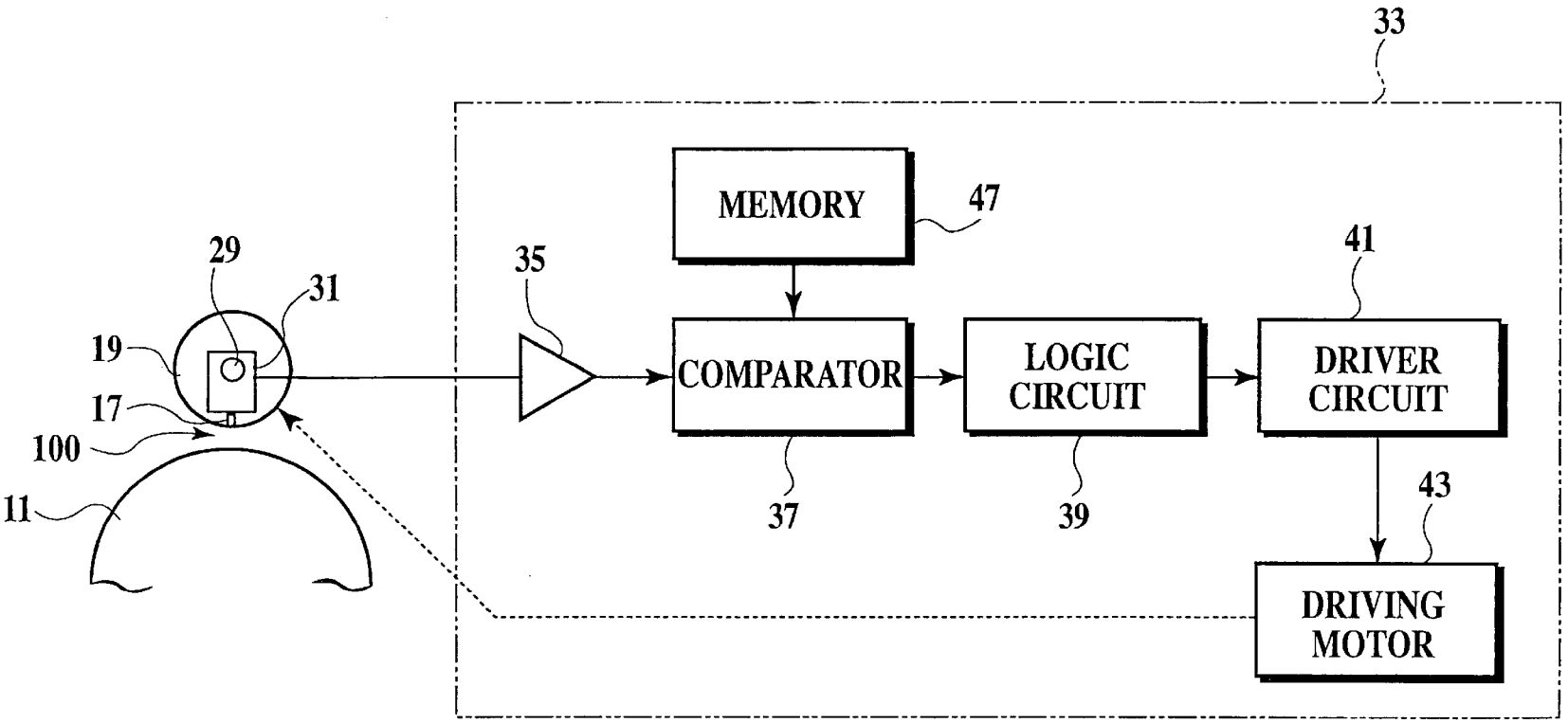
FIG. 2 is a block diagram showing an essential portion of the first embodiment.

As shown in FIGS. 1 and 2, an electrocoagulation printing apparatus 1 comprises a frame body 2 forming a frame of the apparatus 1, a positive electrode 11, a coating device 13, an ink supply device 15, a printing head 19 including negative electrodes 17, a squeegee block (removing means) 21, a pressure roller (transfer means) 23, a positive electrode cleaning device 25, an eddy-current distance sensor (gap measurement sensor) 31, and a gap control device 33. The positive electrode 11, the coating device 13, the ink supply device 15, the printing head 19, the squeegee block 21, the pressure roller 23, the positive electrode cleaning device 25, the eddy-current distance sensor 31, and the gap control device 33 are supported by the frame body 2.

The frame body 2 includes a base plate 5 supported by a plurality of legs 3, a plurality of frames 9 extending upward from the base plate 5, and a pair of vertical plates 7 fixed on an upper portion of the frames 9. The positive electrode is of a cylindrical shape, and is rotatably connected between the vertical plates 7. The positive electrode 11 is rotted by a driving motor which is not shown. The positive electrode 11 extends in the horizontal direction (perpendicular to the paper surface of FIG. 1). The positive electrode 11 is provided at its outer peripheral surface with a passivated surface defining a positive electrode active surface.

The passivated surface is an electrode surface made of metal material. The passivated surface includes a passivated layer which is dissolved by electrical energization of the negative electrodes to generate trivalent metal ions. The generated metal ions coagulate the ink. Appropriate examples of the positive electrode material are stainless steel, chromium, nickel, aluminum and the like which have anticorrosive properties against electrolyte.

The printing head 19 is disposed above the positive electrode 11, and the negative electrodes 17 are opposed to the active surface of the positive electrode 11. The negative electrodes 17 are formed into pin-shape, and are arranged along the direction of the rotary axis of the positive electrode 11 (perpendicular to the paper surface of FIG. 1) at an appropriate distance from one another. A gap 100 is formed between the negative electrodes 17 and the active surface of the positive electrode 11.

The coating device 13 is disposed alongside (right side in FIG. 1) of the positive electrode 11. The coating device 13 coats the positive electrode active surface with oily material.

The ink supply device 15 and the squeegee block 21 are disposed on both sides of the printing head 19. The ink supply device 15 is located between the coating device 13 and the printing head 19 (obliquely upper direction from the positive electrode 11) for supplying ink to the gap 100.

The negative electrodes 17 are electrically energized to cause selective coagulation of the ink supplied from the device 15, and form dots of coagulated ink representing a desired image on the active surface of the positive electrode 11.

Examples of appropriate material of the negative electrode 17 are the same as those of the positive electrode 11, or metal having anticorrosive properties against electrolyte included in ink, more particularly, stainless steel, chromium, nickel, aluminum, tungsten and the like.

The squeegee block 21 removes non-coagulated ink from the positive electrode active surface. The pressure roller 23 is disposed below the squeegee block 21. The pressure roller 23 brings the paper web (substrate) 101 into contact with dots of the coagulated ink. Thereby, the coagulated ink is transferred to the web 101, and the image is printed on the web 101. The positive electrode cleaning device 25 is disposed below the positive electrode 11, and removes any remaining coagulated ink which was not transfer from the positive electrode active surface.

The electrocoagulation printing is carried out as follows:

The coating device 13 coats the active surface of the rotating positive electrode 11 with oily material. The ink supply device 15 injects, into the gap 100, the electrocoagulation printing ink which having coloring agent and coagulated by metal ion generated from the positive electrode 11. The negative electrodes 17 are electrically energized, and dots of coagulated ink representing the desired image are formed on the active surface of the positive electrode 11.

The squeegee block 21 removes the non-coagulated ink from the active surface of the positive electrode 11. The web 101 is contacted with the dots of the coagulated ink between the positive electrode 11 and the pressure roller 23, the coagulated ink is transferred from the active surface to the web 101, and the desired image is printed on the web 101. The printed web 101 is sent to a next process by a plurality of guide roller 27.

Olefinic substances are preferable as oily material used at the coating device 13 for coating the surface of the positive electrode 11. Examples of suitable olefinic substances are unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. A particularly preferred olefinic substance contains 50% or more of oleic acid. The oily material can contain an oxide such as a metal oxide, and the oily material can be applied to the positive electrode active surface in the form of oily dispersion including the metal oxide as dispersed phase. Examples of appropriate metal oxide are aluminum oxide, ceric oxide, chromium oxide, cupric oxide, iron oxide, magnesium oxide, manganese oxide, titanium dioxide and zinc oxide. The amount of metal oxide may range from about 1 to about 50% by weight, based on the total weight of the dispersion.

The printing head 19 forming the dots of the coagulated ink includes a plurality of negative electrodes 17, and the negative electrodes 17 are electrically insulated from each other, and arranged in rectilinear alignment. The negative electrodes 17 are disposed in a plane parallel to the direction of the rotary axis (longitudinal direction) of the positive electrode 11. The negative electrodes 17 are spaced from the positive electrode active surface by a predetermined gap 100, and each of the negative electrodes 17 is spaced from one another by a distance at least equal to the gap 100. The ink supply device 15 charges electrically coagulatable liquid ink (electrocoagulation printing ink) into the gap 100. Selected one or some of the plurality of negative electrodes 17 are electrically energized, and to cause point-by-point selective coagulation and adherence of the ink onto the oily material-coated positive electrode active surface opposite the electrode active surface of the energized negative electrode 17 while the positive electrode 11 rotates.

The electrically coagulable and substantially liquid ink which is charged from the ink supply device 15 into the gap 100 contains at least a polymer, a coloring agent, a liquid medium and a soluble electrolyte. Suitable average molecular weight of the polymer is about 10,000 to about 1,000,000, preferably 100,000 to 600,000. Examples of suitable polymer are natural polymers such as albumin, gelatin, casein and agar, and synthetic polymers such as polyacrylic acid, and polyacrylamide. A particularly preferred polymer is an anionic copolymer of acrylamide and acrylic acid sold by Cyanamid Inc under the trade mark ACCOSTRENGTH 86. It is preferably to use the polymer in an amount of about 5 to 15% by weight based on the total weight of the ink.

Examples of preferable electrolyte are alkali metal halides and alkaline earth metal halides, such as lithium chloride, sodium chloride, potassium chloride and calcium chloride. It is preferable to use the electrolyte in an amount of about 5 to 15% by weight based on the total weight of the ink. As the coloring agent, a dye or a pigment may be used, That is, examples of the dye are indigo dye, azo dye, anthraquinone dye, fluoran dye, oxadine dye, dioxadine dye and phthalocyanine dye. Examples of pigment are organic pigment such as an azo pigment, a phthalocyanine pigment, a quinacridone pigment, an anthraquinone pigment, a dioxadine pigment, a thioindigo pigment, a perinone pigment, a perylene pigment, an isolndolinone pigment, an azomethine pigment, a diketopyrrolopyrrole pigment and an isoindoline pigment; and carbon black. If the coloring agent is the pigment, dispersant is used so that the pigment is dispersed uniformly in the liquid medium. A preferable dispersant is anionic dispersant which is an alkali metal salt of a naphthalene sulfonic acid formaldehyde condensate. It is preferable to use the pigment in an amount of about 6.5 to 12% by weight based on the total weight of the ink, and it is preferable to use the dispersant in an amount of about 0.4 to 6% by weight based on the total weight of the ink.

It is preferable to use water as liquid medium for providing a desired ink by solving or dispersing the polymer, the coloring agent and the electrolyte.

The eddy-current distance sensor 31 is mounted to a supporting axis 29 supporting the printing head 19. The eddy current distance sensor 31 always measures the size of the gap 100 (distance between the positive electrode 11 and the negative electrode 17) so as to stably obtain high-quality printing by always controlling the gap 100 between the positive electrode 11 and the negative electrode 17 within an established range (for example, 50 $\mu$m±5 $\mu$m).

The gap control device 33 includes an amplifier 35, a comparator 37, a logic circuit 39, a driver circuit 41 and a driving motor 43 such as pulse motor.

The eddy current distance sensor 31 is connected to the driving motor 43 through the amplifier 35, the comparator 37, the logic circuit 39 and the driver circuit 41, A memory 47 is connected to the comparator 37, and an established value H0 (for example H0=50 $\mu$m) is stored in the memory 47.

While electrocoagulation printing is carried out (while the positive electrode 11 is rotating), the size of the gap 100 between the positive electrode 11 and the negative electrode 17 is output from the eddy current distance sensor 31 as a normal measurement value H. The output measurement value H is input to the comparator 37 through the amplifier 35 of the gap control device 33.

The established value H0 stored in the memory 47 is taken into the comparator 37. In the comparator 37, the measurement value H and the established value H0 are compared, and "difference value $\Delta H=H-H0$" is calculated. The difference value $\Delta H$ obtained by the calculation is input to the logic circuit 39. In the logic circuit 39, a suitable driving amount of the driving motor 43 for maintaining the difference value $\Delta H$ within a permissible amount $\Delta H0$ (e.g., 5 $\mu$m) is previously established in accordance with the difference value $\Delta H$. The logic circuit 39 outputs, to the driver circuit 41, the suitable driving amount in accordance with the difference value $\Delta H$ output from the comparator 37. The driver circuit 41 drives the driving motor 43 by the suitable driving amount output from the logic circuit 39. With this operation, the printing head 19 approaches or is separated from the positive electrode 11 so that the difference value $\Delta H$ falls within the permissible amount $\Delta H0$.

Therefore, while the positive electrode 11 is rotating (the electrocoagulation printing apparatus is operating), the eddy-current distance sensor 31 always measures and outputs the size of the gap 100, and the gap control device 33 control the size of the gap 100 such that the measured value H always falls within the range of $(H0-\Delta H0)\leqq H\leqq(H0+$ ΔH0), As a result, the operator need not frequently check and adjust the size of the gap 100. At the same time, it is possible to stably obtain the print image of high quality. Further, even if thermal displacement is generated due to the temperature variation in structures such as the frames 7 or the pressure roller 23, the size of the gap 100 is automatically maintained at an appropriate value irrespective of the thermal displacement. Furthermore, by using the eddy-current distance sensor 31 as the gap measurement sensor, the size of the gap 100 can be precisely measured reliably irrespective of whether the coagulated ink exists in the gap 100. The initial setting of the gap 100 is conducted by contacting the negative electrodes 17 to the surface of the positive electrode 11, or sandwiching a thickness gauge between the positive electrode 11 and the negative electrode 17.

A moving mechanism for moving the printing head 19 up and down when the size of the gap 100 is controlled by the gap control device 33 will be explained.

Figure 3:
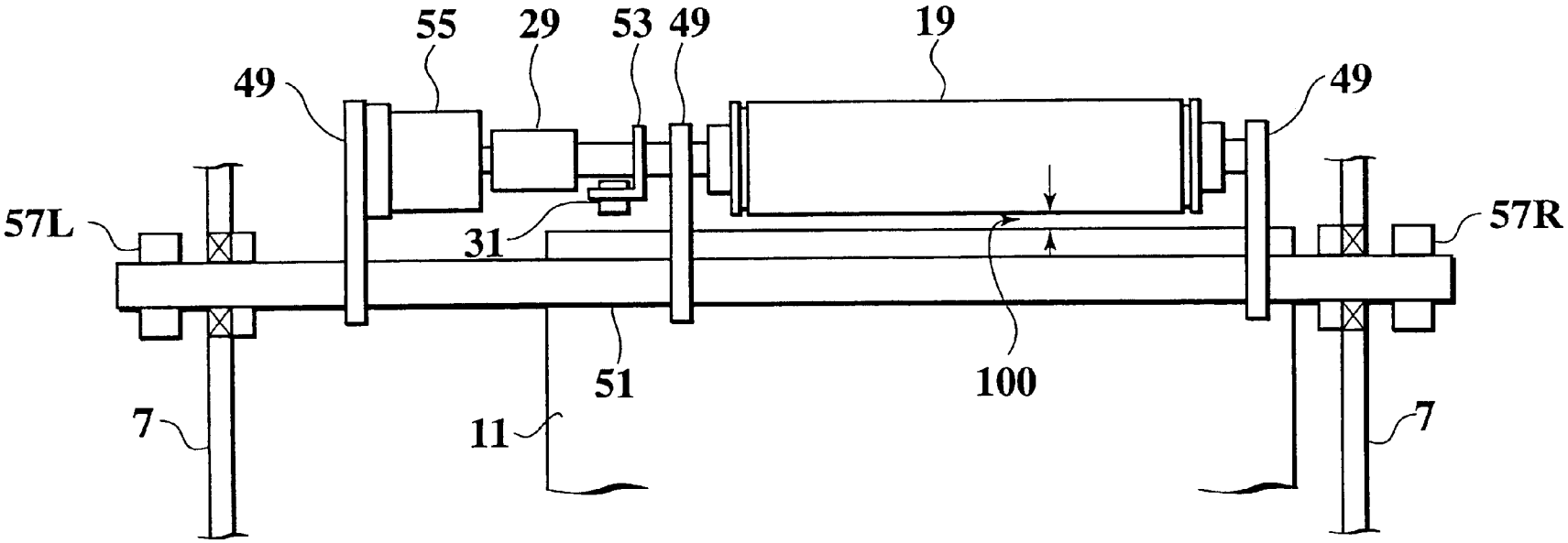
FIG. 3 is an enlarged front view of an essential portion of FIG. 1.
Figure 4:
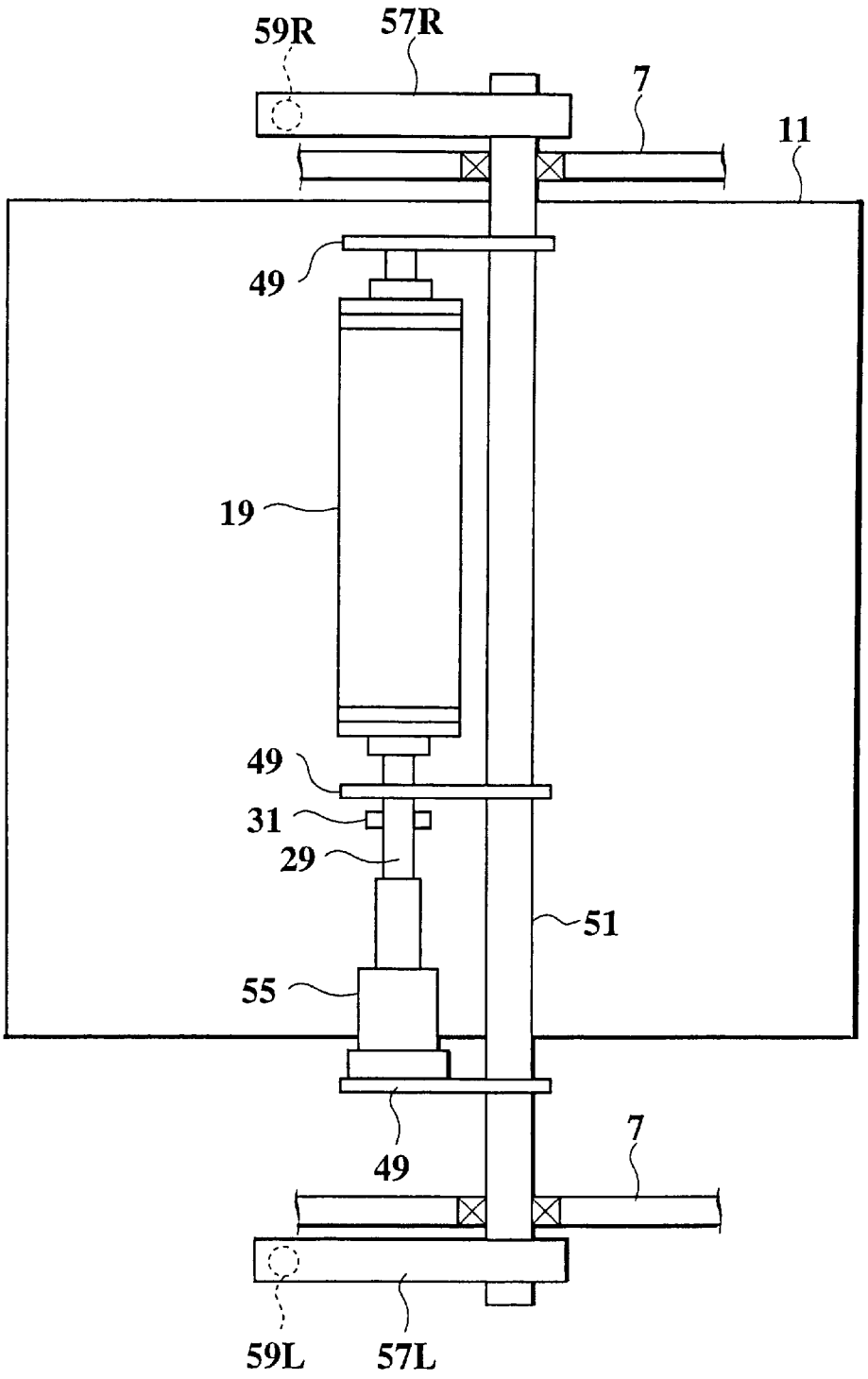
FIG. 4 is a plan view of FIG. 3.

As shown in FIGS. 3 and 4, the printing head 19 is fixed to the supporting axis 29 extending in the horizontal direction (lateral direction in FIG. 3). The supporting axis 29 and a rotary axis 51 are connected through a plurality of supporting bars 49. The rotary axis 51 extends in the horizontal direction (lateral direction in FIG. 3) substantially in parallel to the supporting axis 29. The eddy-current distance sensor 31 is fixed to the supporting axis 29 through a fitting tool 53. A rotating driving motor 55 such as a hydraulic motor is mounted to one of the supporting bars 49 (the left supporting bar 49 in FIG. 3). The rotating driving motor 55 is connected to the supporting axis 29.

Figure 5:
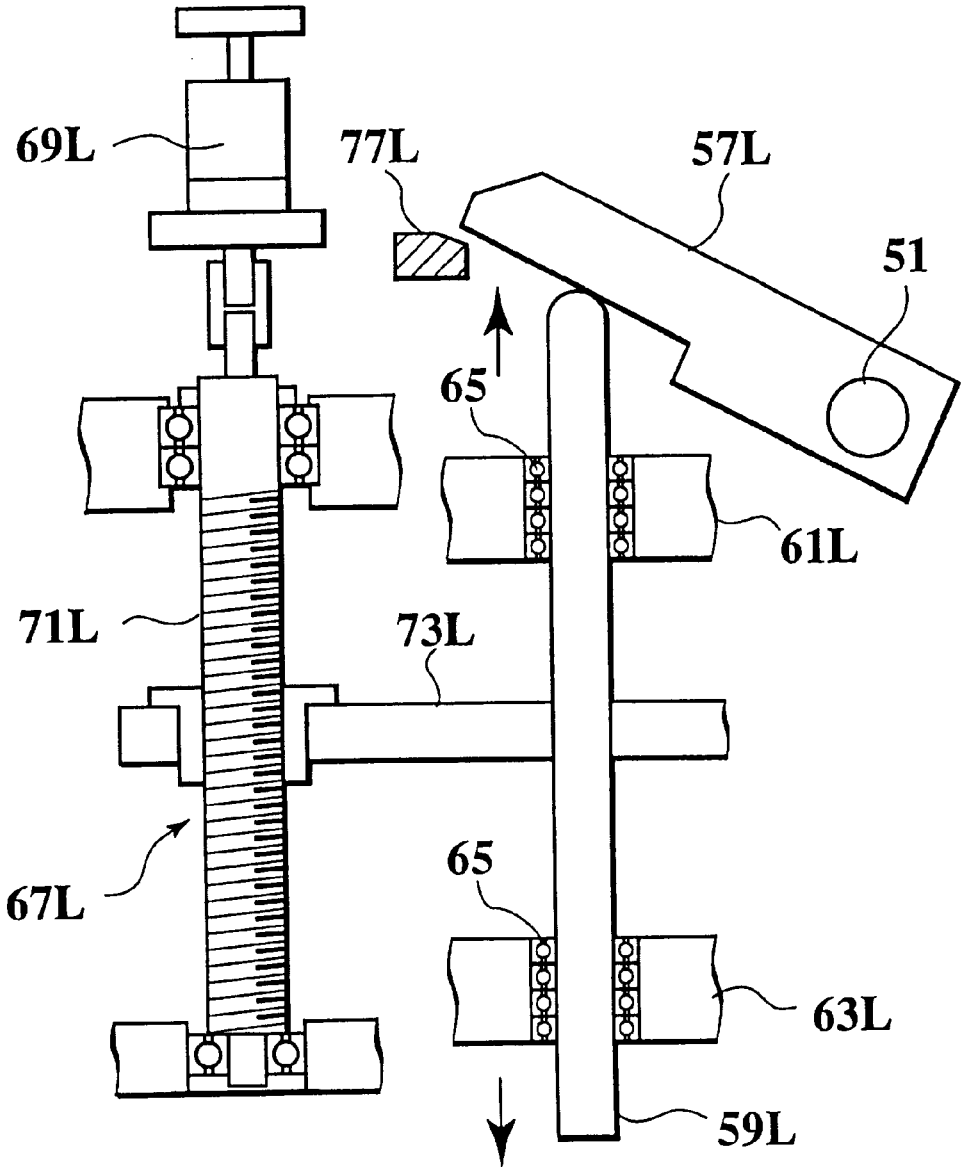
FIG. 5 is a left side view of FIG. 4.
Figure 6:
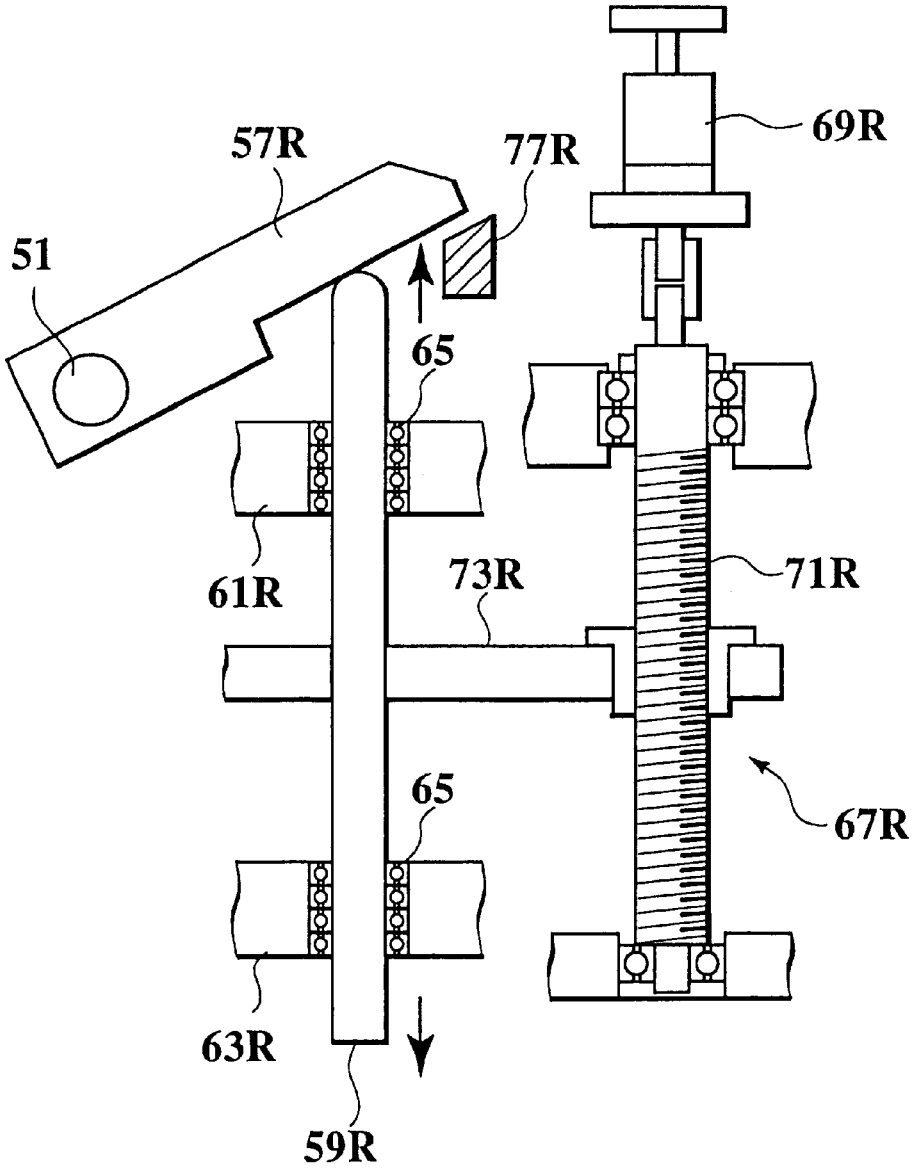
FIG. 6 is a right side view of FIG. 4.

The both sides of the rotary axis 51 is rotatably connected to the frames 7. Levers 57L and 57R project from the both ends of the rotary axis 51. As shown in FIGS. 5 and 6, vertically extending push bars 59L and 59R are disposed below the tip ends of the lever 57L and 57R, respectively. The push bars 59L and 59R includes tip ends capable of engaging and contacting with lower surfaces of the tip ends of the lever 57L and 57R, respectively, and the pass through the linear bearing 65 in vertically separated frames 61L, 61R, and 63L, 63R. The linear bearing 65 smoothly moves the push bars 59L and 59R up or down.

Driving motors 69L and 69R (corresponding to the driving motor 43) such as pulse motors are linked to the push bars 59L and 59R via drive transmission mechanisms 67L and 67R, respectively. The drive transmission mechanisms 67L and 67R include ball screws 71L, 71R and nut members 73L, 73R. The ball screws 71L and 71R are connected to the driving motors 69L and 69R, and extend in the vertical direction. One ends of the nut members 73L and 73R are threadedly engaged with the ball screws 71L and 71R, and the other ends of the nut members 73L and 73R are integrally formed with the push bars 59L and 59R.

If the driving motors 69L and 69R are operated, the ball screws 71L and 71R of the drive transmission mechanisms 67L and 67R rotate, and the nut members 73L and 73R move up or down. By the movements of the nut members 73L and 73R, the push bars 59L and 59R move up or down, and each end of the levers 57L and 57R is moved up or down. With these movements, the rotary axis 51 rotates, the supporting axis 29 is moved up or down through the supporting bars 49, and the printing head 19 approaches or is separated from the positive electrode 11. Therefore, the size of the gap 100 is changed.

When the electrocoagulation printing is not carried out, the supporting axis 29 is rotated by the rotating driving motor 55. With this rotation, the printing head 19 rotates, and the negative electrodes 17 of the printing head 19 move up. Therefore, it is possible to prevent the dry coagulated ink from adhering to the negative electrodes 17.

Second abutment portions 77L and 77R are disposed below the levers 57L and 57R. The second abutment portions 77L and 77R are contacted with the levers 57L and 57R so as to prevent the levers 57L and 57R from excessively moving down. Therefore, it is possible to prevent a case that the printing head 19 excessively moves down and collides against the positive electrode 11 and are damaged.

Figure 7:
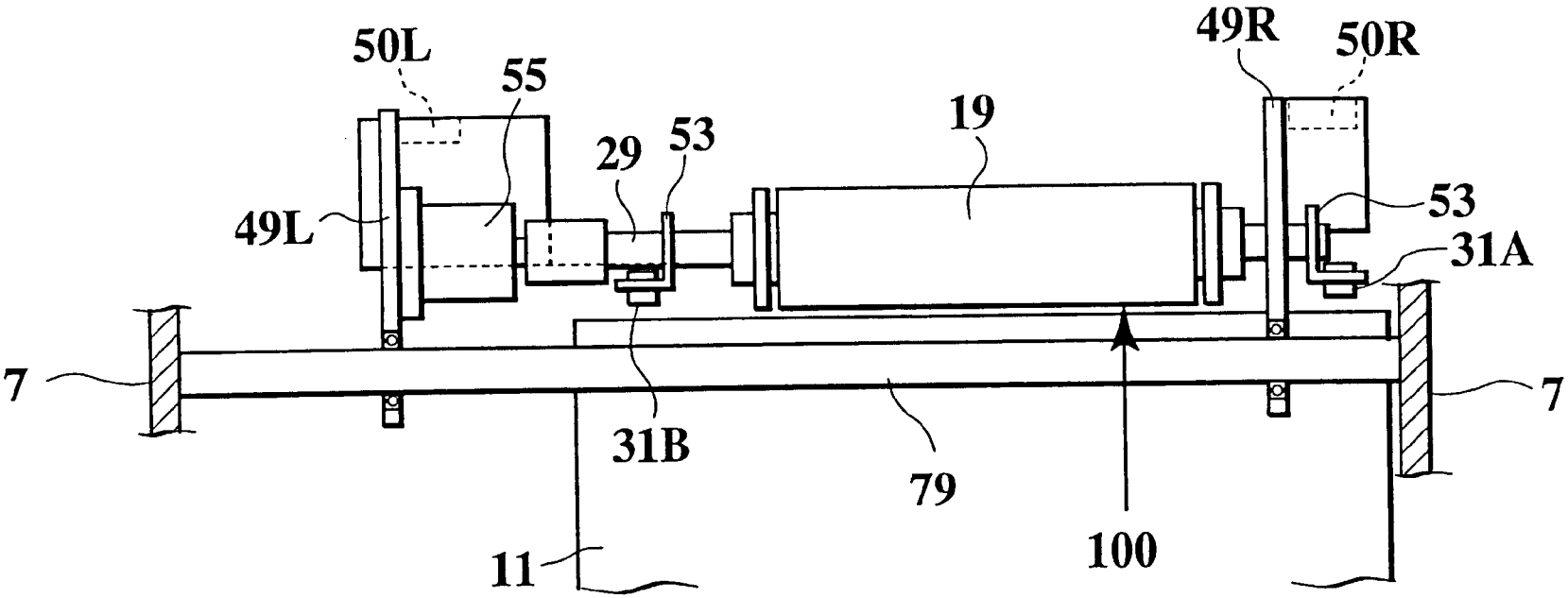
FIG. 7 is an enlarged front view of an electrocoagulation printing apparatus of a second embodiment.
Figure 8:
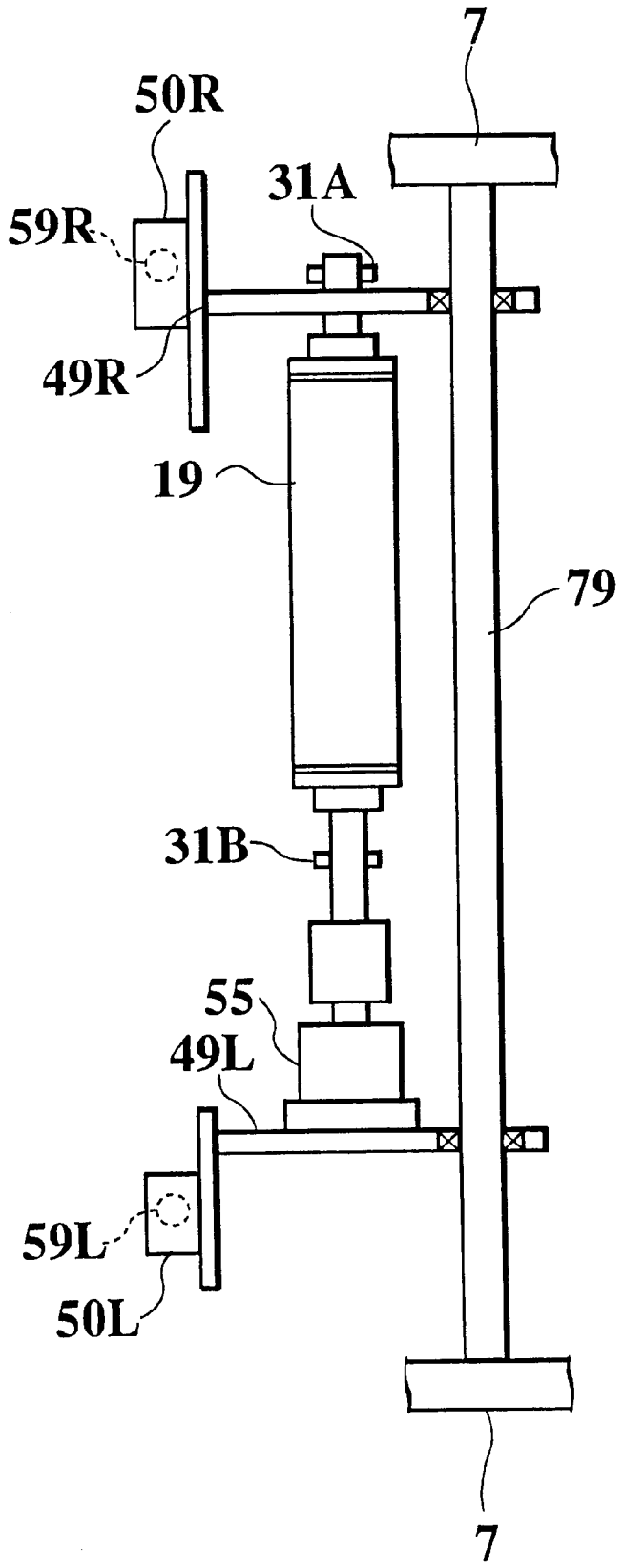
FIG. 8 is a plane view of FIG. 7.

In a second embodiment, a moving mechanism shown in FIGS. 7 and 8 is used instead of the moving mechanism of the first embodiment shown in FIGS. 3 and 4. Constituent elements similar to those in the first embodiment are designated with the same reference member, and repetitive explanation will be omitted.

As shown in FIGS. 7 and 8, two eddy-current distance sensors 31A and 31B disposed on the both sides of the printing head 19 are fixed to the supporting axis 29 through fitting tools 53. Two supporting bars 49L and 49R are connected to the both ends of the supporting axis 29. One ends of the supporting bars 49L and 49R are rotatably connected to a shaft 79 fixed to the frames 7 and extending in the horizontal direction (lateral direction in FIG. 7). The other ends of the supporting bars 49L and 49R are provided with first abutment portions 50L and 50R. The push bars 59L and 59R are disposed below the first abutment portions 50L and 50R.

Figure 9:
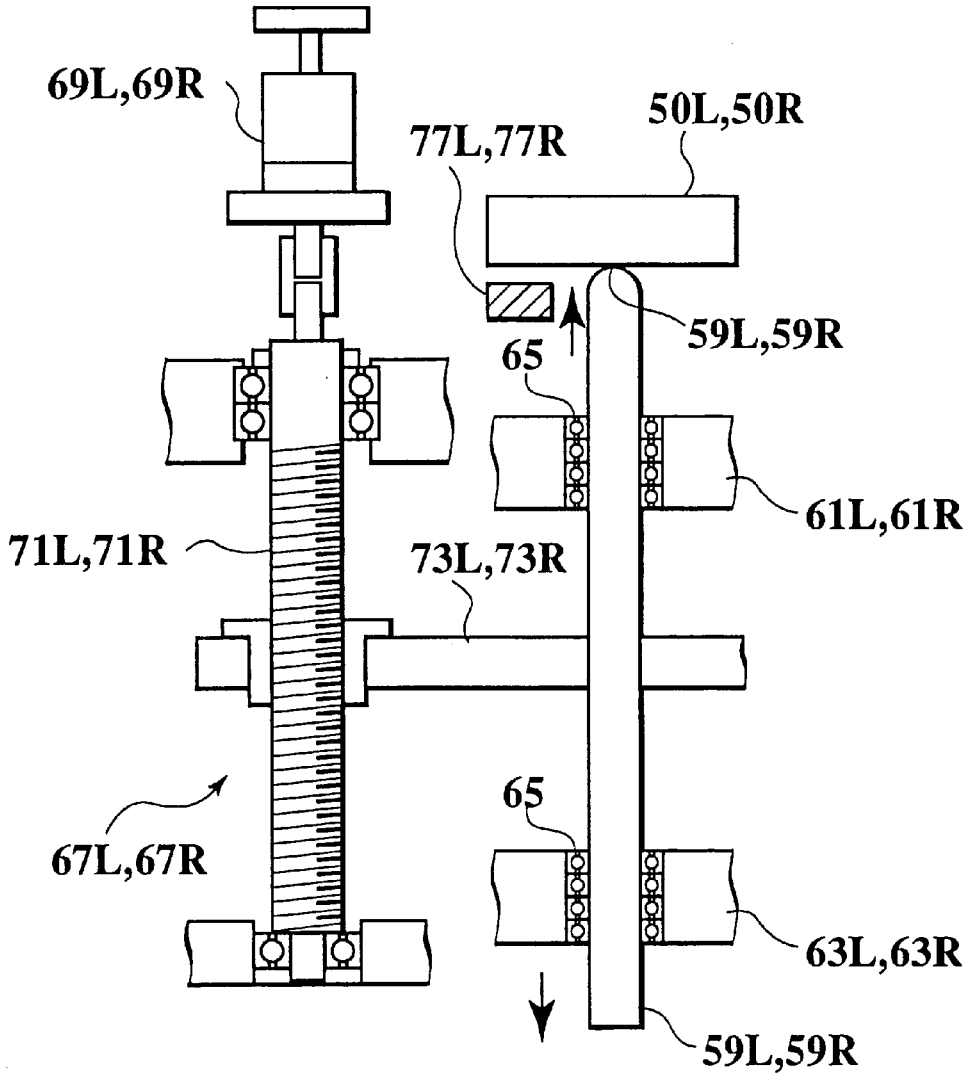
FIG. 9 is a side view of FIG. 8.

As shown in FIG. 9, if the driving motors 69L and 69R (corresponding to the driving motor 43 in FIG. 2) are operated, the ball screws 71L and 71R of the drive transmission mechanisms 7L and 67R are rotated, and the nut member 73L and 73R move up or down. By the movements of the nut members 73L and 73R, the push bars 59L and 59R move up or down, and the first abutment portions 50L and 50R move up or down. With these movements, as shown in FIG. 8, the supporting bars 49L and 49R pivot with respect to the shaft 79, the supporting axis 29 is moved up or down, and the printing heat 19 approaches or is separated from the positive electrode 11.

In the gap control device 33 having the same structure as that shown in FIG. 2, measurement values $H_1$ and $H_2$ of each of the eddy-current distance sensors 31A and 318 are input to the comparator 37 through the amplifiers 35. The established value H0 stored in the memory 47 is taken into the comparator 37. In the comparator 37, the measurement values $H_1$ and $H_2$ are compared with the established value H0 respectively, and "difference value $\Delta H_1 = H_1 - H0$" and "difference value $\Delta H2 = H_2 - H0$" are calculated. The difference values $\Delta H_1$ and $\Delta H_2$ are input to the logic circuit 39. In the logic circuit 39, suitable driving amounts of the driving motor 43 (69L and 69R) for restricting the difference values $\Delta H_1$ and $\Delta H_2$ within the permissible amounts ΔH0 (e.g., 5 $\mu$m) are previously set in accordance with the difference values $\Delta H_1$ and $\Delta H_2$. The logic circuit 39 outputs the suitable driving amounts corresponding to the difference values $\Delta H_1$ and $\Delta H_2$ output from the comparator 37 to the driver circuit 41. The driver circuit 41 drives the driving motor 43 (69L and 69R) by the suitable driving amount output from the logic circuit 39. With this operation, the printing head 19 approaches or is separated from the positive electrode 11 such that both the difference values $\Delta H_1$ and $\Delta H_2$ fall within the permissible amount ΔH0. In the logic circuit 39, both the suitable driving amounts of the driving motors 69L and 69R may commonly be set in accordance with the two difference values $\Delta H_1$ and $\Delta H_2$. Alternately, the suitable driving amount of the driving motor 69L may be set in accordance with the one difference value $\Delta H_1$ (difference value corresponding to the measurement value $H_1$ of the sensor 31A which approaches the first abutment portion 50R), and the suitable driving amount of the driving motor 69L may be set in accordance with the other difference value $\Delta H_2$ (difference value corresponding to the measurement value $H_2$ of the sensor 31B which approaches the first abutment portion 50L).

According to the present embodiment, it is possible to appropriately control the size of the gap 100 formed in wide region along the direction of the rotary axis of the positive electrode 11.

The rotating driving motor 55 as well as the second abutment portions 77L and 77R exhibit the same function and effect as those in the first embodiment.

Figure 10:
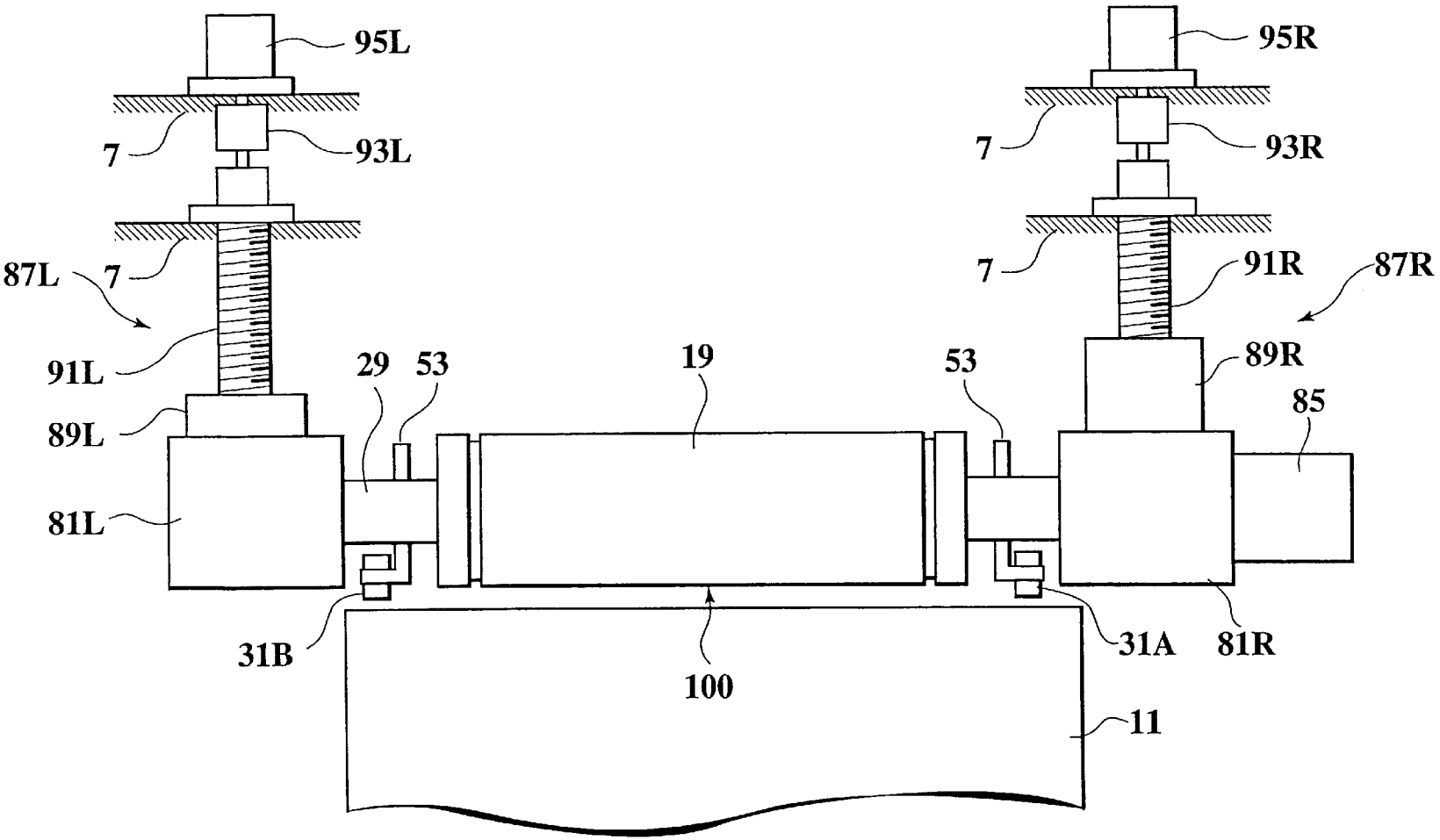
FIG. 10 is an enlarged front view of an electrocoagulation printing apparatus of a third embodiment.
Figure 11:
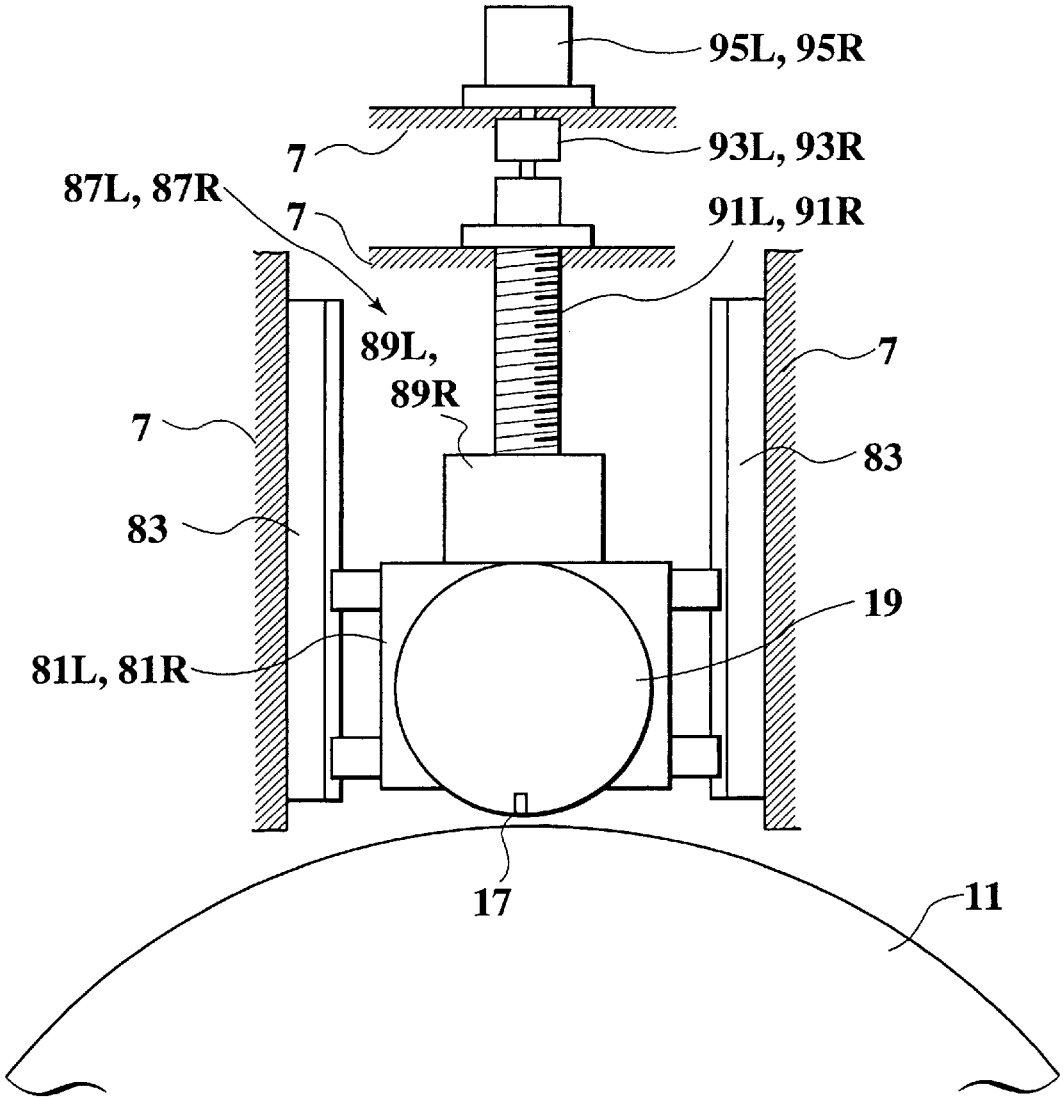
FIG. 11 is a side view of FIG. 10.

In a third embodiment, a moving mechanism shown in FIGS. 10 and 11 is used instead of the moving mechanism of the second embodiment shown in FIGS. 7 and 8. Constituent elements similar to those in the first and second embodiments are designated with the same reference member, and repetitive explanation will be omitted.

As shown in FIG. 10, the supporting axis 29 is provided at its both ends with head supporting blocks 81L and 81R. As shown in FIG. 11, the head supporting blocks 81L and 81R are guided by straight guide bearings 83 on the vertically extending frames 7 and disposed movably up and down. Ahead rotating motor 85 is disposed on the one head supporting block 81R, and the rotating motor 85 is connected to one end (right end in FIG. 10) of the supporting axis 29.

Nut members 89L and 89R constituting portions of driving apparatuses 87L and 87R are integrally formed on upper portions of the head supporting blocks 81L and 81R. Ball screws 91L and 91R are threadedly engaged with the nut members 89L and 89R. Upper ends of the ball screws 91L and 91R are connected to driving motors 95L and 95R such as pulse motors fixed to the frames 7 through couplings 93L and 93R.

When the electrocoagulation printing is not carried out, the supporting axis 29 is rotated by the head rotating motor 85. With this operation, the printing head 19 rotates, and the negative electrodes 17 of the printing head 19 move up. Therefore, it is possible to prevent the dry coagulated ink from adhering to the negative electrodes 17.

If the driving motors 95L and 95R (corresponding to the driving motor 43 in FIG. 2) are operated, the ball screws 91L and 91R are rotated through the couplings 93L and 93R, and the head supporting blocks 81L and 81R move up or down through the nut members 89L and 89R. With this operation, the supporting axis 29 moves up or down, and the printing head 19 approaches or is separated from the positive electrode 11.

The present invention should not be limited to the above embodiments, and can be carried out in other modes with appropriately modification. The gap measurement sensor should not be limited to the eddy-current distance sensor 31. For example, a groove may be formed in an outer periphery of one end of the cylinder forming the positive electrode 11, the gap measurement sensor may be provided above an outer portion of the groove to which the coagulated ink is not adhered, and the size of the gap between the positive electrode 11 and the negative electrode 17 may be detected. In such a structure, it is possible to excellently use a distance sensor other than the eddy-current distance sensor 31. The present invention should not be limited to the drive transmission mechanisms 67L and 67R constituted by the ball screws 71L and 71R and the nut members 73L and 73R. For example, it is possible to use other drive transmission mechanisms such as a rack and a pinion.

What is claimed is:

1. An electrocoagulation printing apparatus comprising:

a positive electrode having a positive electrode active surface;

a printing head having a negative electrode spaced from the positive electrode active surface by a gap;

feed means for supplying ink into the gap, dots of coagulated ink for representing it desired image produced from the ink on the positive electrode active surface as the negative electrode is electrically energized;

removing means for removing any non-coagulated ink from the positive electrode active surface;

transfer means for bringing a substrate into contact with the dots of coagulated ink to cause transfer of the coagulated ink from the positive electrode active surface onto the substrate and thereby imprint the substrate with the image;

gap measurement means utilizing eddy-current for measuring the gap defining an inter-electrode distance between the positive electrode active surface and the negative electrode; and gap control means for controlling the gap according to output from the gap measurement means.

2. An electrocoagulation printing apparatus according to claim 1, wherein the gap measurement means includes a gap measurement sensor, the gap control means includes a driving arrangement, and the driving arrangement moves the negative electrode so that a measured value by the gap measurement sensor falls within an established value.

3. An electrocoagulation printing apparatus according to claim 2, further including a movable unit with the printing head and the gap measurement sensor, and wherein the positive electrode is connected to a frame body, the movable unit is movably connected to the frame body, and the driving arrangement moves the movable unit.

4. An electrocoagulation printing apparatus according to claim 3, wherein the movable unit includes a supporting axis, a rotary axis and a lever, the printing head and the gap measurement sensor are fixed with respect to the supporting axis, the supporting axis is fixed with respect to the rotary axis, the rotary axis is rotatably connected to the frame body, the lever is projected from the rotary axis, the driving arrangement includes a push bar, a drive transmission mechanism, and a driving motor, the push bar is movable up and down and comes in engagable contact with the lever for moving the lever, and the driving motor is linked to the push bar via the drive transmission mechanism.

5. An electrocoagulation printing apparatus according to claim 1, wherein the gap measurement means includes first and second gap measurement sensors, the gap control means includes a driving arrangement, and the driving arrangement moves the negative electrode so that a first measured value by the first gap measurement sensor falls within a first established value and a second measured value by the second gap measurement sensor falls within a second established value.

6. An electrocoagulation printing apparatus according to claim 1, wherein the gap measurement means includes first and second gap measurement sensors, the gap control means includes first and second driving arrangements, and the first and second driving arrangements move the negative electrode so that a first measured value by the first gap measurement sensor falls within a first established value and a second measured value by the second gap measurement sensor falls within a second established value.

7. An electrocoagulation printing apparatus according to claim 6, further including a movable unit with the printing head and the first and second gap measurement sensors, and wherein the positive electrode is connected to a frame body, the movable unit is movably connected to the frame body, and each of the driving arrangements independently moves the movable unit.

8. An electrocoagulation printing apparatus according to claim 7, wherein the movable unit includes a supporting axis and first and second supporting bars, the printing head and the gap measurement sensors are fixed with respect to the supporting axis, the supporting bars are rotatably connected to a shaft fixed to the frame body, the supporting axis is connected between the first and second supporting bars, each of the driving arrangements includes a push bar, a drive transmission mechanism, and a driving motor, each of the supporting bars has a first abutment portion, the push bar is movable up and down and comes in engageable contact with the first abutment portion for moving each of the supporting bars, and the driving motor is linked to the push bar via the drive transmission mechanism.

9. An electrocoagulation printing apparatus according to claim 4, wherein the drive transmission mechanism includes a nut member, a vertical ball screw and a second abutment portion, the nut member is fixed with respect to the push bar, the ball screw is screwed with the nut member, and the second abutment portion is provided below the lever.

10. An electrocoagulation printing apparatus according to claim 8, wherein the drive transmission mechanism includes a nut member, a vertical ball screw and a second abutment portion, the nut member is fixed with respect to the push bar, the ball screw is screwed with the nut member, and the second abutment portion is provided below each of the supporting bars.

11. An electrocoagulation printing apparatus according to claim 7, wherein the movable unit includes a supporting axis with first and second head supporting portions, the printing head and the gap measurement sensors are fixed with respect to the supporting axis, and each of the driving arrangements moves each of the head supporting portions respectively.

12. An electrocoagulation printing apparatus according to claim 11, wherein each of the driving arrangements includes a nut member. a ball screw and a driving motor, the nut member is arranged to each of the head supporting portions, and the ball screw is extended from the frame body, screwed with the nut member and connected to the driving motor.

13. An electrocoagulation printing apparatus according to claim 1, wherein the gap measurement means comprises an eddy-current type distance sensor.

14. An electrocoagulation printing apparatus according to claim 1, wherein the gap measurement means includes a gap measurement sensor, the gap control means includes a driving arrangement, and the driving arrangement moves the negative electrode so that a measured value by the gap measurement sensor agrees with an established value.

* * * * *